United States Patent [19]

Spangrud et al.

[11] Patent Number: 4,483,019

[45] Date of Patent: Nov. 20, 1984

[54] DRY DIVING SUIT WITH WRAPAROUND DOUBLE KNEE PORTION AND METHOD OF MAKING THE SAME

[75] Inventors: Bruce D. Spangrud, Scappoose; Paul H. Gunderson; Ann K. Whinston, both of Portland, all of Oreg.

[73] Assignee: Off-Shore Diving Equipment, Scappoose, Oreg.

[21] Appl. No.: 553,776

[22] Filed: Nov. 21, 1983

[51] Int. Cl.[3] ..... B63C 11/04; A41D 13/06; A41D 27/24; A41B 3/06

[52] U.S. Cl. ..... 2/2.1 R; 2/82; 2/275; 2/23

[58] Field of Search ..... 2/2.1 R, 2.1 A, 2, 82, 2/46, 69, 79, 80, 23, 24, 227, 232, DIG. 5, 275, 243 A, 243 B; 36/2 R; 112/418

[56] References Cited

U.S. PATENT DOCUMENTS

| | | | |
|---|---|---|---|
| 687,077 | 11/1901 | Sprang | 2/82 |
| 1,527,825 | 2/1925 | Baggerud | 2/46 X |
| 2,099,620 | 11/1937 | Pleiter et al. | 2/79 |
| 2,569,451 | 10/1951 | Browne | 2/82 X |
| 3,246,621 | 4/1966 | Copeland | 2/2.1 R X |
| 3,444,570 | 5/1969 | Smith | 2/2.1 R X |
| 3,490,184 | 1/1970 | Bird | 112/418 X |
| 3,496,572 | 2/1970 | Herzig | 2/79 X |
| 3,670,339 | 6/1972 | Cooper et al. | 2/24 X |
| 3,731,319 | 5/1973 | O'Neill | 2/2.1 R |
| 3,758,963 | 9/1973 | Knight | 36/2 R |
| 3,763,498 | 10/1973 | Rector | 2/2.1 R |
| 4,276,341 | 6/1981 | Tanaka | 2/82 X |
| 4,365,351 | 12/1982 | Doerschuk et al. | 2/2.1 R |
| 4,416,027 | 11/1983 | Perla | 2/2.1 R X |

*Primary Examiner*—Werner H. Schroeder
*Assistant Examiner*—Judith L. Kravitz
*Attorney, Agent, or Firm*—Klarquist, Sparkman, Campbell, Leigh & Whinston

[57] ABSTRACT

A dry diving suit has a protective piece which extends completely around each leg, the underlying material of the leg and the protective piece being united longitudinally only at the inseam. A two-layer leg is thus provided with but one longitudinal seam. Each leg is glued at its lower edge to a latex sock. The protective piece is seamed circumferentially to the leg above the glue line of the sock. The inseam extends vertically down only to the circumferential seam of the protective piece.

15 Claims, 7 Drawing Figures

FIG. 1
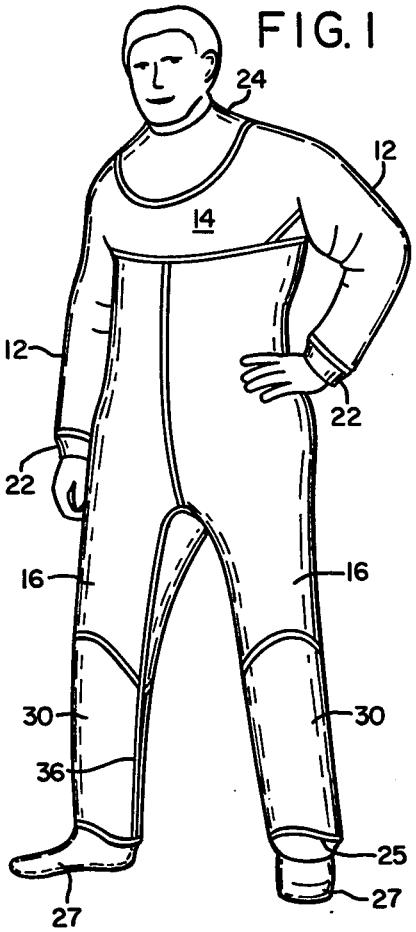
FIG. 2
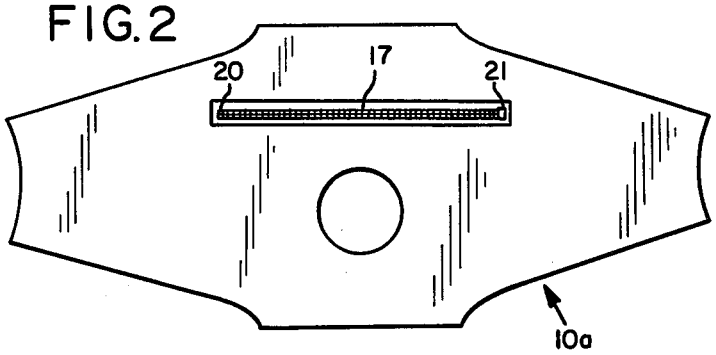
FIG. 3
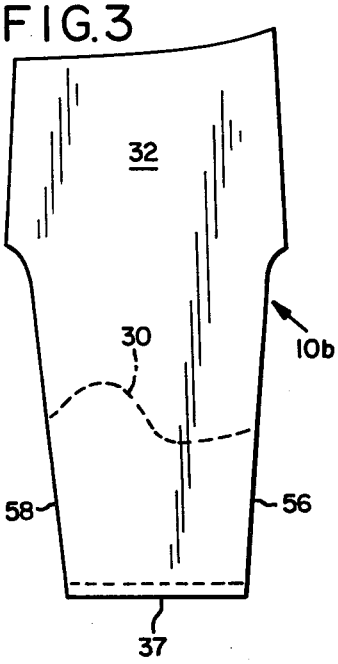
FIG. 5
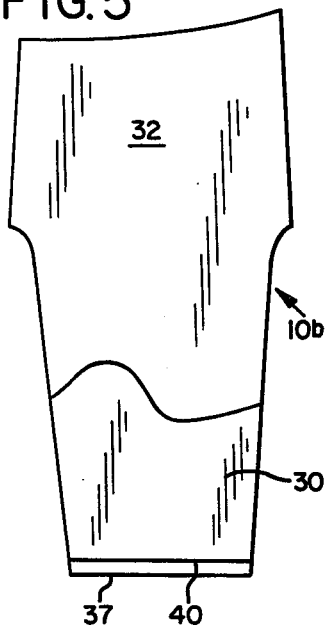
FIG. 7
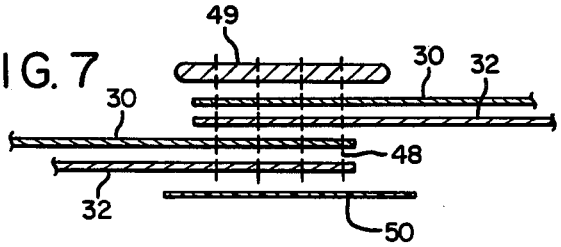
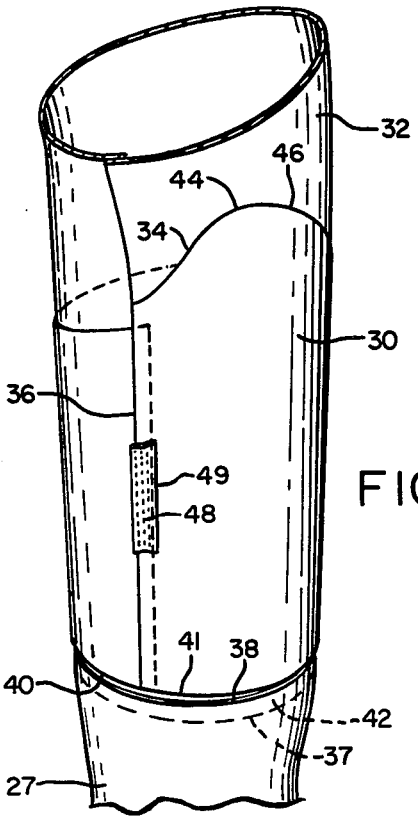
FIG. 6
FIG. 4
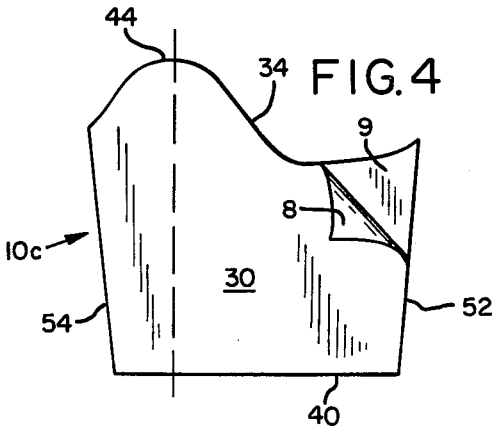

DRY DIVING SUIT WITH WRAPAROUND DOUBLE KNEE PORTION AND METHOD OF MAKING THE SAME

BACKGROUND OF THE INVENTION

This invention relates to the field of diving suits and more particularly, to diving suits known as "dry suits".

Diving suits include suits generally known as "wet suits" and "dry suits". The former are suits made of thermally insultaing rubberized material, generally close fitting to the body, and adapted so that a thin layer of water exists between the suit and the wearer's body. The suit once wet, does not exchange much water, thus the thin layer of water adjacent the wearer's body does not dissipate much heat.

Dry suits, in contradistinction to wet suits, are more effective in conserving body heat especially in extremely cold water conditions. The dry suit is a relatively loose fitting, watertight suit, which is adapted to be worn over relatively heavy, thermally protective insulating underwear. In the dry suit, the diver's skin does not get wet. Examples of dry suits are shown in the following U.S. Pat. Nos. 2,569,451; Smith 3,444,570; O'Neill 3,731,319; and Doerschuk, et al. 4,365,351.

Dry diving suits tend to experience their greatest wear in the area of the knee and lower leg. If the diver gets on his knees, the front of the leg portion tends to abrade. Also, working underwater often provides circumstances whereby the back of the leg portion is subject to abrasion. Prior art suits attempted to solve this problem by applying a pad or other piece of protective material mainly over the knee area.

In prior art suits, such a knee pad was attached to the leg portion by exterior seams which wore out quickly. Also, it was difficult properly to locate the pad with respect to the leg of the garment during fabrication prior to seaming the leg. If the pad were not precisely positioned, when the leg was seamed, the pad was often out of place, as for example, being located somewhat to the side of the knee or above or below it.

Accordingly, it is a principal object of the present invention to provide a dry diving suit with a protective piece for the leg portion thereof which will extend completely around the leg portion, providing a double layer, but which will present no seam in a location which will be subject to wear.

It is a further object of the present invention to provide a suit that will facilitate attachment of such a protective and eliminate production sewing and fabricating problems.

A still further object of the present invention is to provide a dry diving suit wherein the leg portion together with the protective piece is fabricated longitudinally only at the inseam.

SUMMARY OF THE INVENTION

In accordance with the aforementioned objects, our underwater diving suit comprises a leg portion fabricated of a first piece of waterproof material and a unitary protective piece of material disposed exteriorly of the first piece and coextensive laterally therewith, such that the protective piece extends completely around the leg portion when the garment is complete. The first piece of material and the protective piece are united longitudinally only at the inseam, whereby the first piece and the protective piece form a circumferentially extending two-layer leg portion joined longitudinally only at the inseam.

Preferably, the upper edge of the protective piece extends vertically generally above the knee at the front of the suit, dipping on a gradual curve to a position generally below the knee at the rear thereof, thereby to minimize binding of the material behind the knee which might otherwise occur due to the double layer of heavy material used.

The leg portion is joined to a waterproof sock or foot portion circumferentially at the lower edge of the first piece. The lower edge of the protective piece is positioned above the lower edge of the first piece and is circumferentially seamed only to the first piece above the lower edge thereof. In this manner water which may enter between the two layers can escape without entering foot portion of the suit.

Our method of making the leg portion comprises providing a first piece of waterproof material, the lateral extent of which is equal to the entire circumferential extent of the leg portion, and which is adapted to be seamed only at the inseam of the leg portion. A piece of protective material is placed over the first piece. The lateral extent of the protective piece is generally coextensive with the lateral extent of the first piece. The first piece and the protective piece are seamed longitudinally only at the inseam, thereby to form a two layer leg portion.

Other objects and advantages will be readily appreciated by reference to the following detailed description when considered in conjunction with the accompanying drawings.

DESCRIPTION OF THE DRAWINGS

FIG. 1 is a front perspective view of a dividing suit embodying the present invention;

FIG. 2 is a pattern for the top of the garment;

FIG. 3 is a left leg pattern for the first piece of material, showing in phantom lines the positioning of the protective piece;

FIG. 4 is a view of a left leg protective piece prior to assembly;

FIG. 5 is a view showing the protective piece in overlaying relationship with the first piece;

FIG. 6 is a view of a portion of the first piece and protective piece in assembled relation; and FIG. 7 is a schematic cross section through a seam.

DESCRIPTION OF THE PREFERRED EMBODIMENT

Referring to the drawings, the dry suit of the present invention is preferably made of 420 denier heat sealable waterproof and airholding nylon material 8 having 3½ ounces per yard of polyurethane backing 9. See FIG. 4. The suit is formed using various pattern pieces, including pieces 10*a*, 10*b* and 10*c* as shown in FIGS. 2, 3 and 4, and has arm portions 12, a body portion 14 and leg portions 16. A single zipper 17 (see FIG. 2) located at the back of the garment and extending from a point 20 beyond one shoulder to a point 21 beyond the opposite shoulder, makes the suit extremely easy to put on and take off. The suit is designed to be worn over thermally protective insulating underwear. Latex cuffs 22 and a latex neck 24 are designed to prevent water entry to the suit. The leg portions 16 are each circumferentially glued at the lower edge 25 thereof to a waterproof foot portion, comprising a latex sock 27.

Dry diving suits like that of the invention experience their greatest wear in the area of the knee and lower leg. If the diver gets on his knee, as is often the case, the front of the lower leg portion tends to abrade. Working underwater also provides circumstances whereby the back of the leg portion is subject to abrasion. Accordingly, a feature of the present invention resides in a unitary protective piece 30 which is disposed exteriorly of and extends completely around each of the leg portions 16.

The entire suit including the leg portions 16 is formed of the polyurethane backed nylon material 8, 9 above described. Each leg portion 16 is formed from a piece 32 cut in accordance with the pattern illustrated in FIG. 3. The protective piece 30, also fabricated of the same material, is cut in accordance with the pattern illustrated in FIG. 4. As shown in FIGS. 3 and 5, the protective piece 30 a lateral extent generally coextensive with the lateral extent of the piece 32 from which the leg portion itself is formed, such that when the garment is fabricated, the first piece 32 and the protective piece 30 form a circumferentially extending two-layer garment throughout the major extent of each leg portion 16.

The protective piece 30 is cut to extend vertically generally above the knee at the front of the suit, dipping on a gradual curve 34 to a position generally below the knee at the rear thereof. The patterns for both pieces 30 and 32 are designed such that the piece 32 and the protective piece 30 are united longitudinally only at the inseam 36, the two-layer construction of the each leg portion 16 thus having but a single longitudinal seam, viz., the inseam 36. (An inseam is defined for the purposes of this invention as a seam which extends from the crotch to the bottom of a trouser leg.)

As shown in FIG. 6, each piece 32 is glued circumferentially at its lower edge 37 to the upper circumferential edge 38 of the latex sock 27. The lower edge 40 of the protective piece 30 is positioned slightly above the lower edge 37 of the piece 32 (about one inch) and is seamed circumferentially thereto at a seam 41 positioned above the glue line 42 of the sock. The inseam 36 extends vertically down only to the circumferential seam 41. In this manner the latex sock 27 does not overlap any seam at the line of its attachment to the lower edge 37 of the leg portion 16.

The protective piece 30 is seamed at its upper edge 44 to the piece 32 at a seam 46. The seams 41 and 46 can "wick" water between the two layers 30 and 32. Because the lower edge 40 of the protective piece 30 is seamed circumferentially only to the piece 32 and slightly above the glue line 42, whereat the leg portion 16 is attached to the latex sock 27, water which builds up between the two layers of material 30 and 32 can escape through the lower seam 41 and is thereby precluded from leaking into the sock 27 itself.

The seams between the pieces 30 and 32 are preferably made with guadruple interlocking stitches 48 and exterior decorative seam tape 49 as diagrammatically shown in FIG. 7. A strip of polyurethane tape 50 is placed over the stitches 48 interiorly of the garment and is heat fused to the polyurethane backing 9 to make each seam perfectly waterproof. Again see FIG. 7.

The sequence of seaming the leg portions 16 is as follows. While the pieces are flat, the protective piece 30 is placed over the piece 32 and is basted thereto. While the pieces are still flat, the upper seam 46 is made, using the exterior tape 49, and the polyurethane tape 50 is heat fused on the inside. The inseam 36 is then made with its exterior tape 49 overlapping the ends of the seam 46. The lower circumferential seam 41 is then made with its exterior tape 49 overlapping the inseam 36. The latex sock 27 is then glued to the lower edge 37 of the piece 32.

Because the protective piece 30 starts above the knee in front of the garment and dips on the gradual curve 34 to below the knee in the rear, binding of the material behind the knee, which might otherwise result due to the double layer of material, is minimized. Because there is only a single longitudinal seam, viz., inseam 36, which unites both the material 32 of the leg portion and the protective piece 30, there are no seams in front of the leg to wear out. Also, the additional material provided by the protective piece 30 completely around the entire lower leg portion of the garment, provides needed reinforcement in this area, all of which tends to abrade during diving operations.

Because the protective piece 30 overlaps the entire width of the piece 32 which is used to form each of the leg portions, production of the garment is facilitated because the only seam is on the inside of the leg at the inseam location. There are no sharp bends which are difficult to seam using this heavy two-layer waterproof material. Because the side edges 52, 54 of the protective piece 30 are generally colinear with the side edges 56, 58 of the piece 32 prior to forming the inseam, proper location of the protective piece 30 with respect to the underlying material 32 of the leg portion presents no problems as respects the correct location of the protective piece.

All of the sewn seams in the garment are made with quadruple interlocking stitches 48. None of the sewn seams uses any glue. All the sewn seams utilize polyurethane tape which is heat fused to the underlying polyurethane backing. The latex sock 27 is glued to the lower edge 37 of the leg portion 16 below the circumferential seam 41 which joins the protective piece 30 thereto. The inseam 36 terminates at the line of the circumferential seam 41. Thus the latex sock 27, when glued to the lower edge 25 of the leg portion 16, does not overlap any sewn which might otherwise tend to present opportunities for leaks. Seaming the protective piece 30 circumferentially only to the piece 32 above the lower edge 37 thereof permits water that builds up between the two layers of material 30 and 32 to escape through the stitching in the lower circumferential seam 41, and thereby precludes any such water leaking into the latex sock 27 itself.

Although a preferred embodiment of the invention has been illustrated, obviously other embodiments and modifications may be made without departing from the spirit of the invention, and all such embodiments and modifications are intended to be included within the scope of the following claims.

We claim:

1. In an underwater diving suit made of waterproof material, a leg portion comprising a first piece of waterproof material; and a unitary protective piece of material disposed exteriorly of the first piece and coextensive laterally therewith, the protective piece extending completely the leg portion, the first piece and the protective piece being united longitudinally only at the inseam, whereby the first piece and the protective piece form a circumferentially extending two-layer leg portion having a single longitudinal seam.

2. The diving suit of claim 1 wherein the upper edge of the protective piece extends vertically generally above the knee at the front of the suit and generally below the knee at the rear thereof.

3. The diving suit of claim 1 wherein the first piece is joined to a foot portion circumferentially at the lower edge of the first piece, the lower edge of the protective piece being positioned above the lower edge of the first piece and being circumferentially seamed only to the first piece above the lower edge thereof, whereby water entering between the first piece and the protective piece can escape without entering the foot portion.

4. The diving suit of claim 3 wherein the inseam extends only to the lower edge of the protective piece.

5. The diving suit of claim 1 wherein the waterproof material comprises a nylon woven fabric and a polyurethane backing, the polyurethane backing being positioned interiorly of the suit.

6. The diving suit of claim 5 in which the inseam comprises a quadruple interlocked stitched seam.

7. The diving suit of claim 6 further comprising a piece of polyurethane tape disposed interiorly over the inseam, the polyurethane tape being heat fused to the polyurethane backing.

8. A method of making the leg portion of an underwater diving suit, comprising providing a first piece of waterproof material, the lateral extent of the first piece being equal to the entire circumferential extent of the leg portion, the first piece being adapted to be seamed only at the inseam of the leg portion;

placing a piece of protective material over the first piece to form a two-layer leg portion, the lateral extent of the protective piece being generally coextensive with the lateral extent of the first piece; and seaming the first piece and the protective piece longitudinally only at the inseam of the leg portion to form a double layer leg portion having a single longitudinal seam.

9. The method of claim 8 wherein the upper edge of the protective piece extends vertically over the first piece to a location generally above the knee at the front of the leg portion and generally below the knee at the rear of the leg portion.

10. The method of claim 8 wherein the lower edge of the first piece is adapted to be joined circumferentially to a foot portion of the suit and the lower edge of the protective piece is positioned above the lower edge of the first piece, and further comprising seaming the lower edge of the protective piece circumferentially only to the first piece.

11. The method of claim 10 comprising seaming the first piece and the protective piece longitudinally at the inseam only to the lower edge of the protective piece.

12. The method of claim 8 wherein the first piece comprises a nylon woven fabric and a polyurethane backing, the polyurethane backing being disposed interiorly of the leg portion.

13. The method of claim 12 further comprising seaming the first piece and the protective piece with a quadruple interlocked stitched inseam.

14. The method of claim 13 further comprising placing a piece of polyurethane tape over the inseam and heat fusing the tape to the polyurethane backing.

15. In an underwater diving suit made of waterproof material, a leg portion comprising a first piece of waterproof material seamed longitudinally only at the inseam; and a protective piece of material disposed exteriorly of the first piece, the protective piece extending over a portion of the first piece in the region of the knee, the protective piece and the first piece being united longitudinally at least at the inseam, whereby the first piece and the protective piece form a two-layer portion in the region of the knee.

* * * * *

UNITED STATES PATENT AND TRADEMARK OFFICE

CERTIFICATE OF CORRECTION

PATENT NO. : 4,483,019

DATED : November 20, 1984

INVENTOR(S) : BRUCE D. SPANGRUD, PAUL H. GUNDERSON & ANN K. WHINSTON

It is certified that error appears in the above-identified patent and that said Letters Patent is hereby corrected as shown below:

Column 1, line 24, before "2,569,451" insert --Browne--;

Column 2, line 17, after "entering" insert --the--;

Column 2, line 36, "dividing" should be --diving--;

Column 3, line 3, "knee" should be --knees--;

Column 3, line 18, after "piece 30" insert --has--;

Column 3, line 30, after "of" delete --the--;

Column 4, line 43, after "sewn" insert --seam--; and

Column 4, line 66, after "completely" insert --around--.

Signed and Sealed this

*Ninth* Day of *April 1985*

[SEAL]

*Attest:*

DONALD J. QUIGG

*Attesting Officer* *Acting Commissioner of Patents and Trademarks*